US005447236A

United States Patent [19]

Perry et al.

[11] Patent Number: 5,447,236

[45] Date of Patent: Sep. 5, 1995

[54] MULTIPLE COMPARTMENT PACKAGE

[75] Inventors: Michael R. Perry, Plymouth; Joseph C. McDilda, Brooklyn Park; Michael J. Rice, St. Paul, all of Minn.

[73] Assignee: The Pillsbury Company, Minneapolis, Minn.

[21] Appl. No.: 215,514

[22] Filed: Mar. 22, 1994

[51] Int. Cl.[6] ..... B65D 85/72

[52] U.S. Cl. ..... 206/541; 206/223; 220/505; 426/120; 426/128

[58] Field of Search ..... 206/216, 217, 526, 541; 215/227, 246; 220/521, 522, 505, 4.01, 23.83, 23.86, 359; 426/112, 119–123, 124, 128

[56] References Cited

U.S. PATENT DOCUMENTS

| | | | |
|---|---|---|---|
| 2,963,194 | 12/1960 | Brennan et al. | 220/23.83 |
| 3,182,890 | 5/1965 | Elam | 426/120 |
| 3,310,195 | 3/1967 | Wagner et al. | 220/521 |
| 3,482,729 | 12/1969 | Penton | 426/120 |
| 3,506,459 | 4/1970 | Parlour | 99/172 |
| 3,542,236 | 11/1970 | Dru | 220/522 |
| 3,589,272 | 6/1971 | Bouladon et al. | 426/120 |
| 3,851,757 | 12/1974 | Turpin | 206/223 |
| 4,114,784 | 9/1978 | Hough et al. | 426/128 |
| 4,465,190 | 8/1984 | Cillario | 206/216 |
| 4,522,298 | 6/1985 | Weinberger | 206/216 |
| 4,538,740 | 9/1985 | Peterson, Jr. | 215/246 |
| 4,634,003 | 1/1987 | Ueda et al. | 220/522 |
| 4,883,935 | 11/1989 | Fairchild et al. | 219/10.55 |
| 4,981,229 | 1/1991 | Lanham | 220/359 |
| 5,141,126 | 8/1992 | Takata et al. | 220/359 |
| 5,312,634 | 5/1994 | Griesbach et al. | 426/120 |

FOREIGN PATENT DOCUMENTS

| | | | |
|---|---|---|---|
| 0981625 | 1/1976 | Canada | 220/521 |

*Primary Examiner*—Jimmy G. Foster

*Attorney, Agent, or Firm*—Janal M. Kalis; Aleya Rahman

[57] ABSTRACT

A multiple compartment package for use in the packaging of foodstuff articles includes a first compartment portion, a second compartment portion, and a retaining mechanism for retaining the first compartment portion in close relation to the second compartment portion.

8 Claims, 5 Drawing Sheets

MULTIPLE COMPARTMENT PACKAGE

BACKGROUND OF THE INVENTION

The present invention relates generally to a multiple compartment package for use in the packaging of food. More particularly, the present invention relates to a multiple compartment package for separately packaging at least two different articles of food that are typically consumed at the same time but that cannot be co-packaged in direct contact with one another.

Consumers today rely upon food that can be rapidly prepared at home. Rapid preparation depends upon food that is pre-prepared to a degree where consumers may merely transfer and heat the food. One type of pre-made food enjoyed by consumers is pre-made dough.

Refrigerated, pre-made dough products are very popular because they enable consumers to enjoy home baked goods without expending the time and effort needed to prepare the dough. These refrigerated doughs range from doughs for biscuits and breads to sweetrolls, to cornbread products. A variety of pre-made dough compositions are known in the art. For example, the Yong et al. patent U.S. Pat. No. 4,381,315, the Matz patents U.S. Pat. Nos. 3,356,506 and 3,397,064, the Atwell patent U.S. Pat. No. 4,526,801 and the Lutz patent U.S. Pat. No. 3,669,682, each describe refrigerated pre-made dough compositions. Refrigerated dough compositions described in these patents generally include about 27 to 36.5 percent water by weight and about 1 to 3.7 percent by weight of leavening agents. The pressure generated by storage of these refrigerated dough compositions is about 1 to 25 psig.

Refrigerated, pre-made dough compositions are typically subjected to a "proofing" step during which leavening agents in the dough begin to react. During the proofing step, the volume of the dough expands by approximately 1 to about 15 percent. After proofing, the dough is further developed by storage in a sealed container at refrigeration temperatures. During this time, the leavening agents complete reacting and the internal pressure of the container reaches a selected equilibrium pressure and the dough attains an equilibrium temperature.

It is desirable to consumers and food manufacturers to package foods such as refrigerated dough products with other foods commonly used with the dough to make a final food product. Unfortunately, these other foods frequently cannot be packaged in direct contact with dough in a single container. For example, foods having a semi-fluid state at ambient temperature, such as icing or butter, are not compatible with a semi-solid state food, such as dough, because moisture and oil migration from the icing or butter into the dough destroy final baked product integrity and organoleptic qualities, such as firmness or palatability. Also, the icing integrity is destroyed when the dough is heated.

Further, food products having multiple constituents, such as icing and dough, require different conditions for packaging and storage. For instance, foods such as icing are packaged under ambient temperatures using gravity loading methods. However, other foods, such as dough, require packaging under cool or warm temperatures in order to pressurize a storage container. The packaged dough is subsequently stored under refrigeration. Refrigerated dough storage containers may include multilayer spirally wound or convolute paper containers, as well as plastic and aluminum cans.

The Turpin patent, U.S. Pat. No. 3,851,757, describes a multiple compartment container having a cylindrical container portion with a closed end and an open end opposite the closed end. A cup is inserted into the open end of the cylindrical container portion and is filled with a desired product. Next, a separator plate is placed over the cup and dough is inserted into the cylindrical container portion. The cylindrical container portion is then sealed and the dough is proofed. Proofing causes the dough to expand in the container and to force the separator plate against the cup to prevent the product in the cup from mixing with the dough. One disadvantage of the container described in the Turpin patent is that placing the cup in the cylindrical container portion increases the complexity of packaging the dough and limits the conditions under which the dough can be packaged.

Another multiple compartment container for packaging incompatible food components is described in the Parlour patent, U.S. Pat. No. 3,506,459. In the Parlour patent, a cylindrical container has a first end and a second end opposite the first end. The first end includes a closure element that includes a circular lip that defines a central opening to the cylindrical container. A cup having a main body and a flange at an end of the main body is inserted into the first end of the cylindrical container. The flange permits the main body of the cup to pass through the central opening of the cylindrical container but prevents the cup from passing through the lip of the closure element. A separating plate is positioned over the cup to cover the cup. A seal formed between the lip of the closure element of the cylindrical container and the flange of the cup allows gas to escape from the container while dough undergoes a proofing step and expands. However, if the dough has not leavened sufficiently to force the separating plate against the icing cup, the cup contents may leak thereby destroying dough developing and container integrity.

Similarly to the packaging described in the Turpin patent, pressure from the expanding dough forces the separating plate against the cup and thereby prevents a food stored in the cup from intermixing with the dough. However, if the dough has not expanded sufficiently to force the separating plate against the cup, the contents of the cup may become intermixed with the dough and thereby degrade the quality of the dough.

Therefore, a multiple compartment container is desired which improves reliability of product quality and consumer handling. It is also desirable that the multiple compartment container ease production and post-production handling. Further, the multiple compartment container should accommodate constituents that are supplied in a liquid, semi-fluid or solid particulate form so that the constituents can be copackaged with the dough constituent.

SUMMARY OF THE INVENTION

The present invention includes a multiple compartment package for use in the packaging of foodstuff articles including a first cylindrical compartment portion, a second cylindrical compartment portion, and a retaining mechanism for retaining the first compartment portion in close relation to the second compartment portion. The first compartment portion includes a cylindrical main body with a cylindrical wall, a first end with an attached lid and a second end opposing the first end.

The lid is attached to the first end such that an annular recess is formed in the cylindrical wall of the main body.

The second compartment portion includes an annular flange with a first side and a second side opposing the first side. The first side of the annular flange is adapted to fit in close relation to either of the first or second end of the first compartment portion.

The retaining mechanism restricts movement of the annular flange of the second compartment portion and fits snugly within the annular recess of the first compartment portion to retain the first compartment portion in close relation to the second compartment portion.

DETAILED DESCRIPTION OF THE PREFERRED EMBODIMENTS

Figure 1:
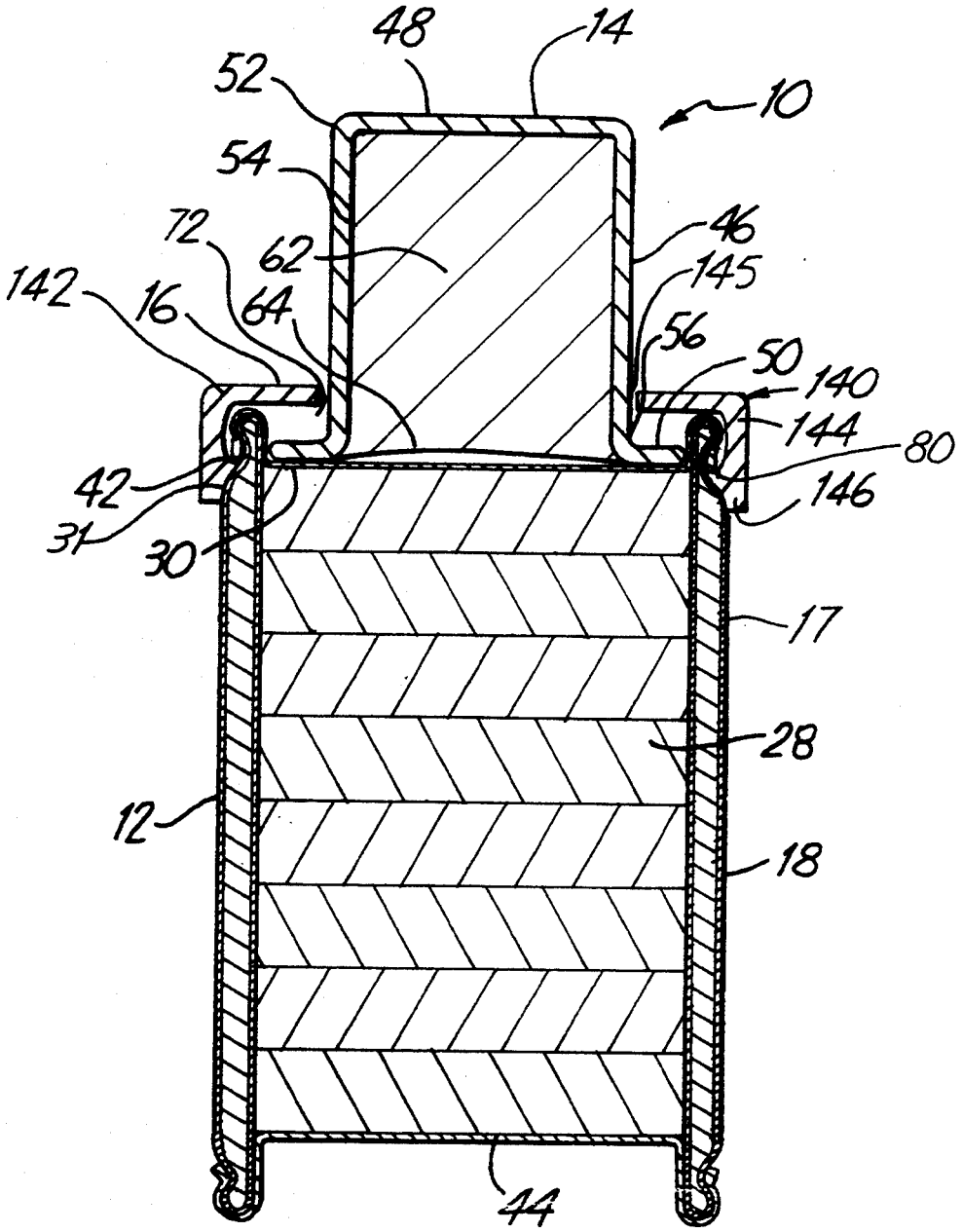
FIG. 1 is a cross-sectional view of the multiple compartment container of the present invention.

A multiple compartment package of the present invention, illustrated generally at 10 in FIG. 1, includes a first compartment portion 12 having a cylindrical main body 17 with an annular wall 18, a second compartment portion 14 with an annular lip 50, and a retaining mechanism 16 conjoining the first compartment portion 12 and the second compartment portion 14.

The multiple compartment package 10 of the present invention solves a heretofore intractable problem of packaging and storing two or more food components that cannot be packed or stored in direct contact with each other prior to consumption. The multiple compartment package 10 also accommodates different processing and packaging requirements of the different food products contained therein. It is contemplated that in one embodiment, the second compartment portion 14 stores a fluid or semi-fluid food such as icing, butter or gravy or a solid particulate food such as nuts or candy and the first compartment 12 stores a food such as dough.

The combination of the first compartment portion 12, the second compartment portion 14 and the retaining mechanism 16 of the present invention permits a separation of diverse functions of the multiple compartment package 10. For instance, the multiple compartment package 10 may optimize product specific features of the package 10 such as compression strength and a peelable seal for the first compartment portion 12 while also providing a strong attachment of the second compartment portion 14 to the first compartment portion 12 with the retaining mechanism 16.

By separating the functions of product specific compartment features and compartment attachment, the sealability of each of the second compartment portion 14 and first compartment portion 12 may be improved by increasing the sealing options. With more sealing options, each of the compartments can be independently sealed according to particular requirements dictated by its contents. Such requirements include, but are not limited to, protecting the contents from the environment and providing sufficient room to accommodate pressure or other changes within a compartment.

Further, the multiple compartment package 10 is easy to open because the retaining mechanism 16 includes a mechanism for loosening the retaining mechanism 16 and separating the second compartment portion 14 and first compartment portion 12 from each other. Additionally, the multiple compartment package 12 has great resistance to blows and other external forces to which packages are subjected during shipping and storage because the retaining mechanism 16 securely joins the first compartment portion 12 and the second compartment portion 14.

The retaining mechanism 16 is provided to retain the second compartment portion 14 and the first compartment portion 12 in a mated arrangement, as illustrated in FIG. 1, prior to preparation of a food product such as is made by baking dough and applying icing to the baked dough. In one embodiment shown in FIG. 1, the retaining mechanism 16 has an outer diameter that is greater than the outer diameter of the first compartment portion 12. Preferably, retaining mechanism 16 has an inner diameter that is somewhat less than the outer diameter of the first compartment portion 12, such that retaining mechanism 16 can be tightly engaged with first compartment 12.

The retaining mechanism 16 defines an aperture 72. In one embodiment, the retaining mechanism 16 attaches first compartment portion 12 and second compartment portion 14 by holding together rim 41 of the first compartment 12 and lip 50 of second compartment 14 within aperture 72.

Figure 2:
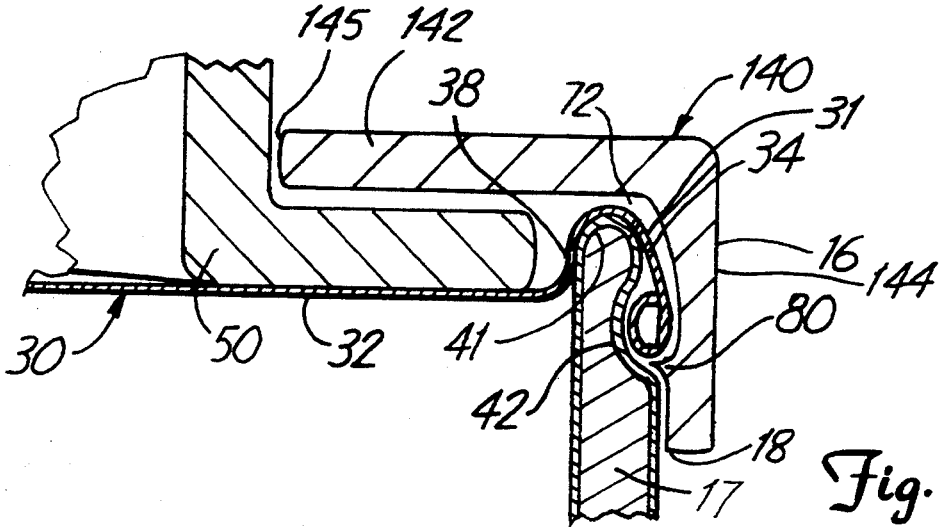
FIG. 2 is, a cross-sectional view of one embodiment of the retaining mechanism of the present invention.

The retaining mechanism 16 is attached to the first compartment portion 12 at a first end 31 of the first compartment portion 12. The first end 31 is sealed with a lid 30 having an inside surface 32 as shown in FIG. 2. The first compartment portion 12 also includes a second end 44 shown in FIG. 1. While a sealing mechanism is described for the first end 31, it is understood that the second end 44 can be sealed in any suitable manner. In one embodiment, second end 44 is sealed in a manner substantially the same as the first end 31. Consequently, the second compartment portion 14 may be attached to the second end 44 with the retaining mechanism 16 in a manner substantially the same as attachment to the first end 31 of the first compartment portion 12.

The lid 30 includes an integral annular lip 34 and an annular shoulder 38 that aid in attachment of the lid 30 to the cylindrical main body 17 as shown in FIG. 2. In particular, lid 30 is attached to the rim 41 of a body wall 18 of the main body 17 by rolling the annular lip 34 of the lid 30 to pinch the body wall 18 of the main body 17 between annular lip 34 and annular shoulder 38. A seamer may be used to roll the annular lip 34 of the lid 30 to the main body 17, whereby lip 34 presses against body wall 18, thereby forming an annular recess 42 in the body wall 18.

Figure 4:
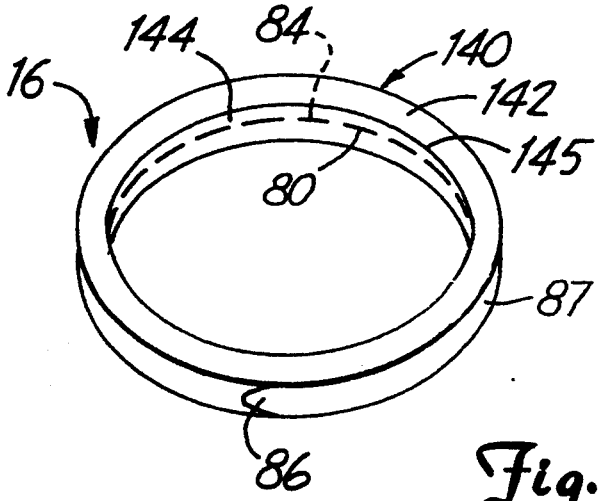
FIG. 4 is a perspective view of one retaining mechanism embodiment of the present invention.

In one embodiment, the retaining mechanism 16 includes a main body 140 having an upper annular segment 142 contiguous with a side annular segment 144. Side annular segment 144 has an outer concentric surface 87 and an inner concentric surface 84 opposing the outer concentric surface 87, as shown in FIG. 4. Upper annular segment 142 and side annular segment 144 define aperture 72. Upper annular segment 142 forms shoulder 145 which retains lip 50 of second compartment portion 14 within the aperture 72. In one embodiment, inner concentric surface 84 is of a diameter that provides sufficient clearance so that the annular lip 50 of the second compartment portion 14 may be positioned and retained on the lid 30 of the first compartment portion 12 when conjoined by the retaining mechanism 16, as illustrated in FIG. 1.

The side annular segment 144 includes a plurality of locking lugs 80, integral to the inner concentric surface 84 of the side annular segment 144 as shown in cross-section in FIG. 2, and concentrically arranged as shown in FIG. 4. The locking lugs 80 are concentrically positioned so that when the retaining mechanism 16 is placed over the lid 30 of the first compartment portion 12, the locking lugs 80 snugly fit within the annular recess 42 of the body wall 18 of the first compartment portion 12 and are held in tension against the annular lip 34 of the first compartment portion 12. Once the locking lugs 80 are in position, the lugs 80 cannot be displaced without altering side annular segment 144. Side annular segment 144 can be altered, for example, by breaking retaining mechanism 16 or by stretching retaining mechanism 16 by prying apart second compartment portion 14 from multiple compartment package 10. Alternatively, the compartments can be separated by removing upper anuular segment 142 of retaining mechanism 16. With any of these arrangements, the first compartment portion 12, the second compartment portion 14, and the retaining mechanism 16 are retained together as the single multiple compartment package 10.

It should be appreciated, however, that while the retaining mechanism 16 has been described as being attached to a first compartment portion 12 with a lid 30 having a shoulder 38 and a lip 34, the retaining mechanism 16 may be used with other types of first compartment portions. However, like the first compartment portion 12 described, the other types of first compartment portions will have the main body wall 18 such as is shown in FIG. 2 having the annular recess 42. Locking lugs 80 of the retaining mechanism 16 will snugly fit within annular recess 42, securing a plurality of compartment portions together as a single multiple compartment package.

In one retaining mechanism embodiment, illustrated at 16 in FIG. 4, the retaining mechanism 16 also includes a pull tab 86 positioned on the outer concentric surface 87 of the retaining mechanism 16. This retaining mechanism 16 embodiment conjoins the second compartment portion 14 and the first compartment portion 12 as described above. Once this embodiment is installed on the multicompartment package 10, a consumer opens the multi-compartment package 10, by gripping the pull tab 86 and tearing the retaining mechanism 16 concentrically, thereby breaching the integrity of the retaining mechanism 16 and the multi-component package 10. Once the retaining mechanism 16 is breached, the second compartment portion 14 may be removed from its position on the first compartment portion 12.

The pull tab 86 and the retaining mechanism 16 are preferably constructed from a flexible material that provides sufficient strength to retain the first compartment portion 12 and the second compartment portion 14 as a single, multiple compartment package unit but allows for easy opening when the consumer attempts to tear the retaining mechanism 16 by gripping the pull tab 86. The retaining mechanism 16 should be made of a material having flexibility and strength characteristics that enable the locking lugs 80 to snugly fit into position within the annular recess 42 and to produce tension when positioning retaining mechanism 16 or when separating the first compartment 12 from the second compartment 14.

Figure 5:
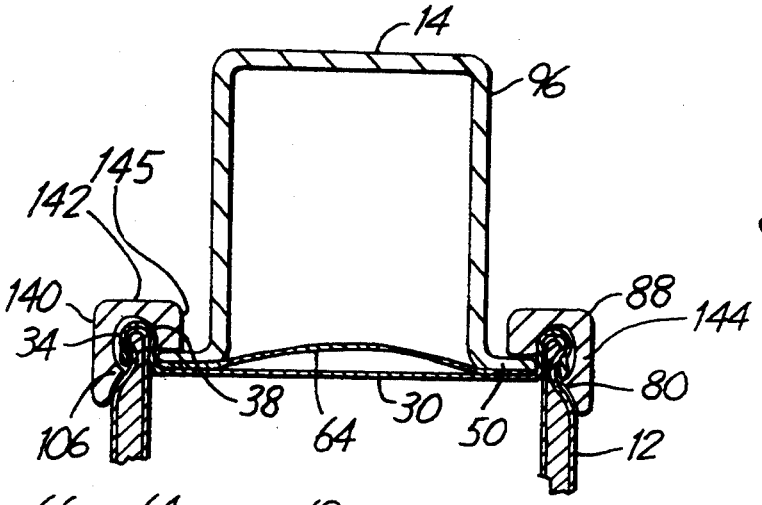
FIG. 5 is a cross-sectional view of another embodiment of the retaining mechanism of the present invention.

In another embodiment of the retaining mechanism illustrated at 88 in FIG. 5, the shoulder 145 of the upper annular segment 142 of the main body 140 is of a thickness that meets the lip 50 of the second compartment portion 14 when engaged in the multiple compartment package 10. The shoulder 145 and the side annular segment 144 and the locking lugs 80 retain the annular shoulder 38 and annular lip 34 of the lid 30 of the first compartment portion 12. The locking lugs 80 of the side annular segment 144 are described above.

One advantage of this embodiment of the retaining mechanism 88 is that the orientation of the second compartment portion 14 with respect to the first compartment portion 12 is retained because the shoulder 145 of the retaining mechanism 88 contacts the lip 50 of the second compartment portion 14 and concurrently, the plurality of locking lugs 80 retain the ring to the first compartment portion 12. The snugness of this relationship precludes concentric movement of any of the portions 12, 14, and 88 of the multi-component package 10. To remove the second compartment portion 14 from the first compartment portion 12, a pull tab such as is shown at 86 in FIG. 4 may be provided to breach the retaining mechanism 88.

Alternately, the materials used to make the retaining mechanism 88 may be selected to permit second compartment portion 14 to be pried apart from first compartment portion 12.

The second compartment portion 14 and annular lip 50 are preferably constructed as a single unit that includes a cylindrical main body 96, illustrated in FIG. 5, using conventional thermoforming techniques. However, other plastic fabrication techniques are also suitable. Preferably the second compartment portion 14 is constructed in a single layer. However, additional material options may be used to provide the second compartment portion 14 with specific attributes such as oxygen barrier, strength and sealability. Such material options may include monolithic or multilayered materials such as produced by, for example, coextrusion or adhesive lamination techniques.

The second compartment portion 14 has a closed first end 52 and an open second end 56 as shown in FIG. 1. A circular cap 48 is integrally formed into the first end 52 of the main body 46. The main body 46 and the cap 48 define an inner cavity 54. The annular lip 50 extends outwardly from the second end 56 of the main body 46. In one embodiment shown in FIG. 1, the diameter of the annular lip 50 is smaller than the diameter of the first end 31 of the first compartment portion 12. Thus, the second compartment portion 14 can be placed on the lid 30 of the first compartment portion 12 prior to being secured with the retaining mechanism 16.

The inner cavity 54 of the second compartment portion 14 is preferably filled with a product 62 that is consumed along with a product in the first compartment portion 12 but that is not suitable for packaging in direct contact with the product in the first compartment portion 12. The product 62 is preferably frosting or icing but one in the art will readily appreciate that a wide range of products such as gravy, butter, chopped nuts or powdered sugar are also suitable for use with a product 62 such as dough stored in the first compartment portion 12.

A closure mechanism 64 is included in the second compartment portion 14 to retain the product 62 in the second compartment portion 14 prior to consumption. The closure mechanism 64 may be made from a variety of flexible materials including roll stock lidding or membrane material. The closure mechanism 64 may also be made of inflexible or rigid materials such as plastic. The closure mechanism 64 may be affixed to the annular lip 50 of the second compartment portion 14 using a variety of methods including heat sealing and adhesive seals.

Figure 5A:
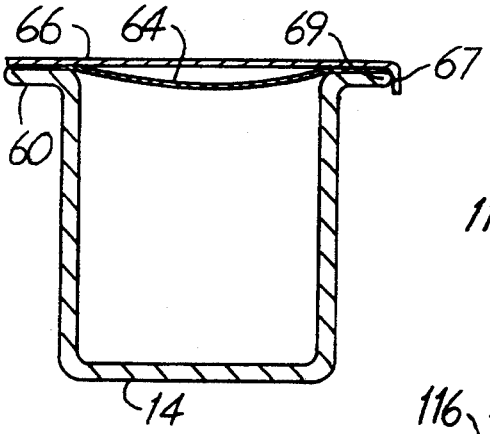
FIG. 5A is a cross-sectional view of one embodiment of the closure mechanism of the present invention.

In one embodiment, the closure mechanism 64 is affixed to the annular lip 50 by a reclosable seal (not shown) that releasably attaches to the lip 50. The reclosable seal (not shown) allows the inner cavity 54 to be resealed if the product 62 in the inner cavity is not used all at once. The reclosable seal (not shown) may include a contact bond adhesive that provides a low to medium strength, permanently tacky bond, that contacts the lip 50. The closure mechanism may additionally or alternatively include a reclosable overcap 66 having a flexible shoulder 67 that reversibly snaps over an end 69 of the annular lip 50 as shown in FIG. 5A.

Figure 6:
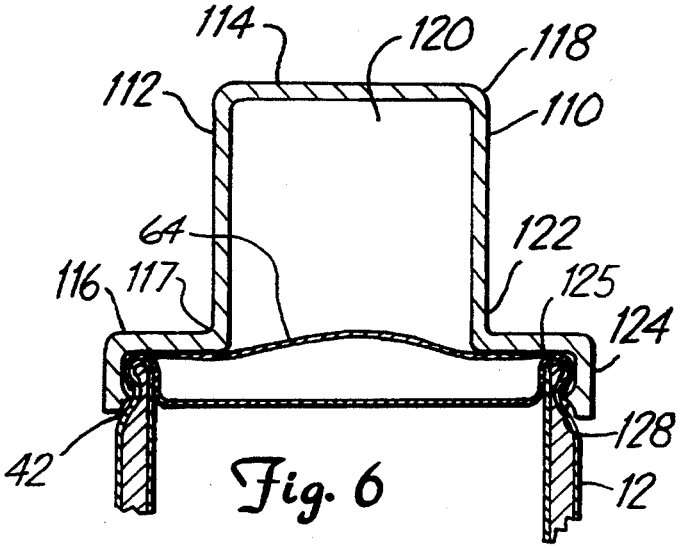
FIG. 6 is a cross-sectional view of another embodiment of the multiple compartment package of the present invention where a second compartment portion and the retaining mechanism are contained in a single unit

In another embodiment, the second compartment portion and the retaining mechanism may be integrally formed into a single unit 110 as illustrated in FIG. 6. The unit 110 includes a second compartment portion 112 having a closed end 114, and an open end 117 terminating in an annular lip 116. The second compartment portion 112 defines an inner cavity 120. The lip 116 terminates in a shoulder 124 having an inner surface 125. The lip 116 is of a diameter that is greater than the diameter of the first compartment portion 12. A plurality of concentrically arranged locking lugs 128 are formed integral with the inner surface 125 and retain the unit 110 in close relation to the first compartment portion 12 once positioned within the recess 42 of the first compartment portion 12. In this embodiment, the annular lip 116 is constructed from a material that is sufficiently rigid so that the lip 116 does not bend to a degree where locking lugs 128 release during normal handling when multiple units 110 are stacked for shipping.

Figure 9:
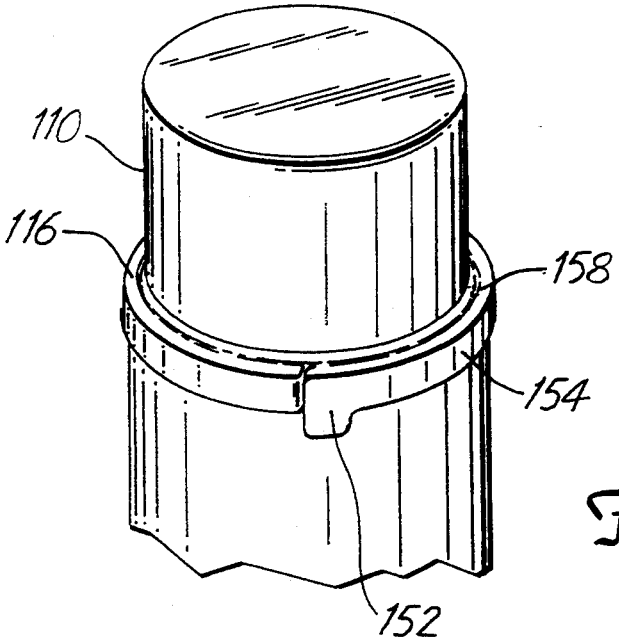
FIG. 9 is a perspective view of one other embodiment of the multiple compartment package where the retaining mechanism is contiguous to the second container portion.
Figure 10:
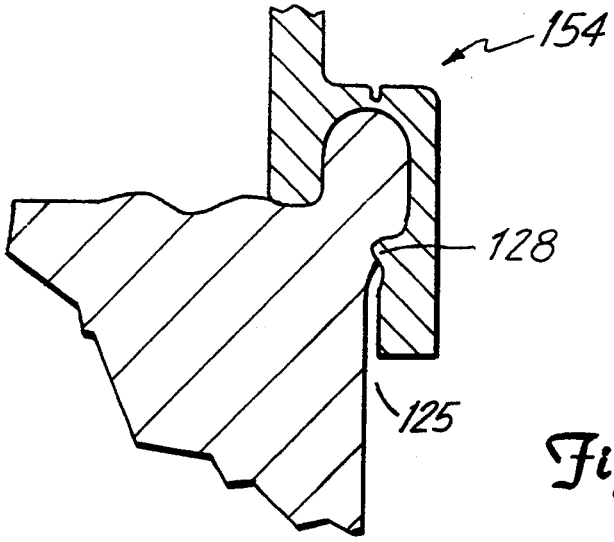
FIG. 10 is a cross-sectional view of the embodiment of the multiple compartment package of the present invention where the retaining mechanism is contiguous to the second compartment portion.

In one embodiment, the single unit 110 further includes a peel ring 154, contiguous to the lip 116 such as is illustrated in FIG. 9. The peel ring 154 includes a pull tab 152 and is delineated by a concentric pattern of perforations 158 on the lip 116. Preferably, the pattern of perforations 158 is positioned within an annular segment of the peel ring 154 having a thickness that is less than a thickness of the lip 116. The peel ring 154 also includes the inner surface 125 and locking lugs 128 that retain the unit 110 in close relation to the first compartment portion 12 as shown in cross-section in FIG. 10. When the peel ring 154 is breached by tearing the ring 154 with the pull tab 156 along the pattern of perforations 158, tension on the locking lugs 128 is released, the locking lugs 128 are displaced and the second compartment 14 is removable from the first compartment 12. Peel ring 154 is preferably made of materials having suitable strength for holding together first compartment 12 and second compartment 14.

Figure 13:
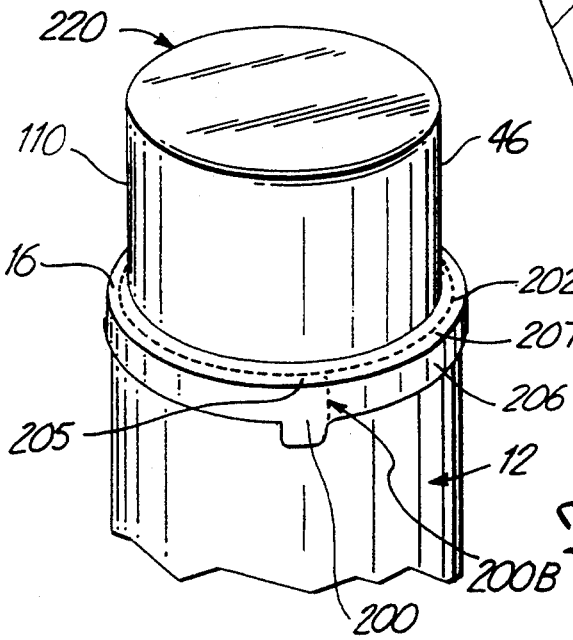

Flipping tab 200 also breaches the integrity of the single unit embodiment 220, shown in FIG. 13, by tearing the tear region 200B, thereby causing the locking lugs 128 to loosen the grip on the first compartment portion 12. Because the tear region 200B intersects the annular ring 207, the tear may be propagated along the annular ring 207 and the thinned region 205, thereby removing the tab 200 and annular side segment 206 from the single unit 220.

Figure 11:
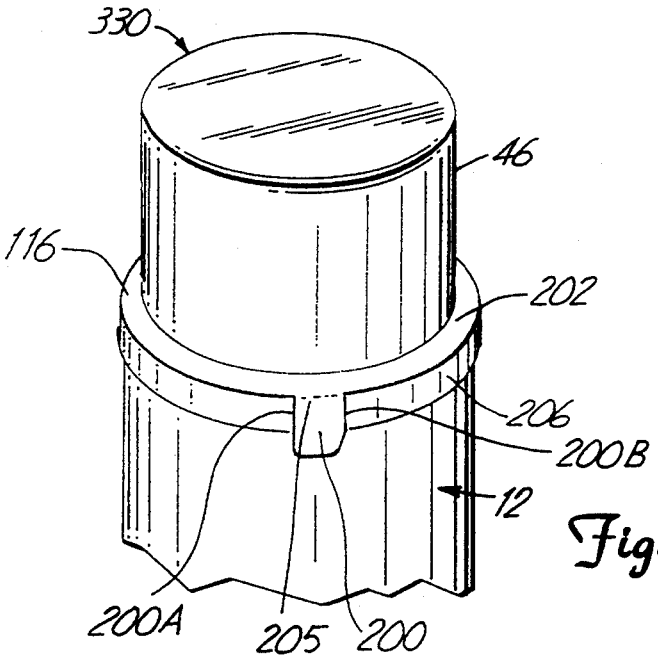
FIGS. 11 and 13 are perspective views of single unit embodiments of the invention.
Figure 12:
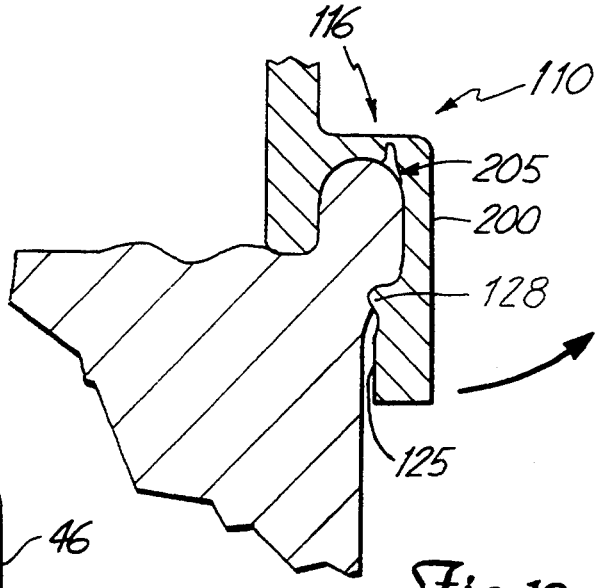
FIG. 12 is a cross-sectional view of a portion of a single unit embodiment of the invention.

In the preferred single unit embodiments shown in FIGS. 11 and 12, the second compartment portion 14 and retaining mechanism 16 may be efficiently and inexpensively made of a single rigid material by a process such as injection molding. Because the tab 200 must visibly change position to open the package 10, the package is tamper evident. Additionally, the retaining mechanism of this preferred embodiment need not be removed to separate the first compartment from the second compartment, as shown in FIG. 11.

Figure 3:
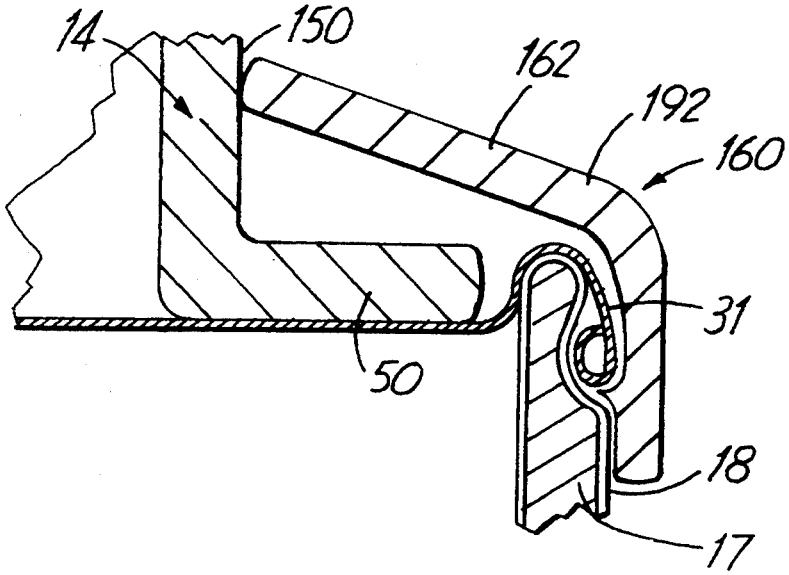
FIG. 3 is a cross-sectional view of one other embodiment of the retaining mechanism of the present invention.

When it is desired to prevent an introduction of debris into the multicompartment container 10 and to prevent movement of the second compartment portion 14, a retaining ring embodiment 160, such as is shown in FIG. 3 may be included. The embodiment 160 includes an extended shoulder 162 of the upper portion 142 extended in a cone shape that contacts the second compartment portion 14 at 150. The cone shaped shoulder 162 prevents dirt and other debris from resting on the retaining ring embodiment 160. By extending the cone shaped shoulder 162 to contact the second compartment portion 14, debris is also prevented from contacting the first end 31 of the first compartment portion 12.

Figure 7:
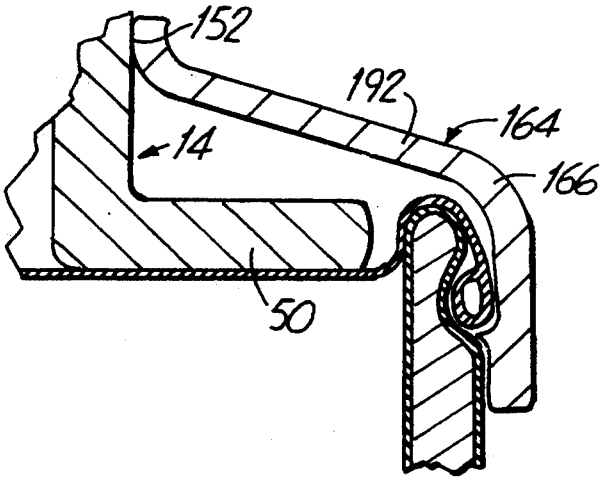
FIG. 7 is a cross-sectional view of another embodiment of the retaining mechanism of the present invention.

One other retaining ring embodiment illustrated at 164 in FIG. 7, includes an upper annular ring portion 142 having a shoulder 166 that terminates in a foot section 152 that contacts the second compartment portion 14. The foot section 152 prevents movement of the second compartment portion 14.

Figure 8:
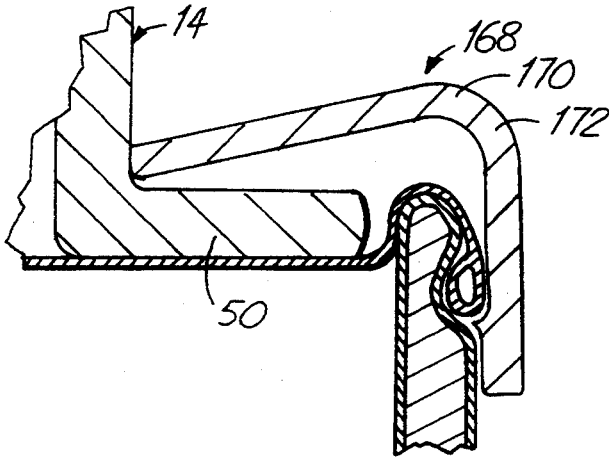
FIG. 8 is a cross-sectional view of one other embodiment of the retaining mechanism of the present invention.

An additional flexible retaining ring embodiment that restrains movement of the second compartment portion 14 is illustrated at 168 in FIG. 8. The retaining ring embodiment 168 includes an upper annular ring portion 172 with a flexible annular ring shoulder portion 170. When installed on the multicompartment container 10 the flexible shoulder portion 170 is extended downward to contact the second compartment portion 14 so that the upper annular portion 172 is held in tension against the second compartment portion 14. The second compartment portion 14 is then restrained by the force holding the upper annular portion 172 in tension.

The multicompartment package 10 of the present invention may include many different types of first compartment portions and embodiments. For instance, in one embodiment, the multi-compartment package 10 may include a first compartment portion 12 having a main body 17 that includes a body wall 18 which can be laminated. In other embodiments, the first compartment portion 12 may include a body wall of a single layer or multiple layers. The first compartment portion may have any one of a butt joint, spiral seam, no seam or other comparable structure.

Although the present invention has been described with reference to preferred embodiments, workers skilled in the art will recognize that changes may be made in form and detail without departing from the spirit and scope of the invention.

What is claimed is:

1. A multiple compartment package for use in the packaging of articles, comprising:

a first cylindrical compartment portion having a main cylindrical body with a cylindrical wall, a first end and an opposing second end, the cylindrical wall having a recess proximate to the first end, the first cylindrical compartment portion further including a lid attached to the first end;

second cylindrical compartment portion that includes a flange integral to the compartment wherein the flange rests upon the lid and is positioned in close relation to the lid; and a single component retaining means for retaining the first compartment portion in close relation to the second compartment portion, the retaining means restricting movement of the flange and positioned within the recess of the first cylindrical compartment portion, the retaining means including a plurality of lugs for engaging the recess.

2. The multiple compartment package of claim 1 wherein the retaining means includes a tab to enable the retaining means to be torn and thereby releasing the second compartment.

3. The multiple compartment package of claim 1 wherein the second cylindrical compartment portion has a lid integrally formed therein opposite the flange.

4. The multiple compartment package of claim 3 and further comprising a sealing membrane that covers the flange end of the second compartment.

5. The multiple compartment package of claim 1 wherein the retaining means includes a concentric ring having an annular shoulder and a plurality of lugs.

6. The multiple compartment package of claim 5 wherein the concentric ring is contiguous to the flange of the second cylindrical compartment portion.

7. A multiple compartment package for use in the packaging of articles, comprising:

a first cylindrical compartment portion having a main cylindrical body with a cylindrical wall, a first end and an opposing second end, the cylindrical wall having a recess proximate to the first end, the first cylindrical compartment portion further including a lid attached to the first end;

a second cylindrical compartment portion that includes a flange integral to the compartment wherein the flange rests upon the lid and is positioned in close relation to the lid; and a single component retaining means for retaining the first compartment portion in close relation to the second compartment portion, the retaining means restricting movement of the flange and positioned within the recess of the first cylindrical compartment portion, the retaining means comprising a main body comprising an upper annular segment that includes a shoulder defining an aperture; a side annular segment contiguous to the upper annular segment defining a cavity that encloses a rim of the cylindrical wall of the first cylindrical compartment portion; the side annular segment including a plurality of lugs that are positioned within the recess of the first cylindrical compartment portion when the retaining main body is attached to the multi-compartment package.

8. The retaining means of claim 7 wherein the shoulder of the upper annular segment contacts the flange of the second cylindrical compartment when the retaining main body is attached to the multiple compartment package.

* * * * *